United States Patent [19]

Calloway, Jr. et al.

[11] Patent Number: 4,713,900

[45] Date of Patent: Dec. 22, 1987

[54] BOWL EMBLEMS

[76] Inventors: Luther Calloway, Jr.; George Spector, both of 233 Broadway Rm 3615, New York, N.Y. 10007

[21] Appl. No.: 680,326

[22] Filed: Dec. 10, 1984

[51] Int. Cl.[4] ..... G09F 3/00

[52] U.S. Cl. ..... 40/324; 40/21 R; 40/310; 40/618

[58] Field of Search ..... 40/20, 21, 324, 310, 40/312, 618, 21 C

[56] References Cited

U.S. PATENT DOCUMENTS

| | | | |
|---|---|---|---|
| 261,131 | 7/1882 | Bonshire | 40/324 |
| 1,616,057 | 2/1927 | Merrill | 40/324 |
| 1,829,861 | 11/1931 | Holt | 40/324 |
| 1,960,690 | 5/1934 | Blair | 40/21 R |
| 2,203,155 | 6/1940 | Julien et al. | 40/21 R |
| 2,224,683 | 12/1940 | Ide et al. | 40/324 |
| 2,689,423 | 9/1954 | Atkin | 40/618 |
| 2,763,142 | 9/1956 | Hepner | 40/324 |
| 2,924,900 | 2/1960 | Hoofer | 40/324 |
| 2,937,460 | 5/1960 | Everett | 40/618 |
| 3,208,170 | 9/1965 | Madey | 40/324 |
| 3,229,398 | 1/1966 | Kopatich | 40/618 |
| 3,787,993 | 1/1974 | Lyon | 40/310 |
| 4,060,920 | 12/1977 | Edwards | 40/618 |
| 4,275,516 | 6/1981 | Lane | 40/324 |

FOREIGN PATENT DOCUMENTS

| | | | |
|---|---|---|---|
| 140255 | 2/1951 | Australia | 40/324 |

*Primary Examiner*—Gene Mancene
*Assistant Examiner*—Wenceslao J. Contreras

[57] ABSTRACT

A super bowl for eating onto which attachments with sports' emblems are changeably mounted. The attachments are slidably removeably mounted to either an internal or external track on the bowl. An elastic band with integral track mounted in a circumferential concave on the bowl, is also available for receiving the attachments.

2 Claims, 6 Drawing Figures

BOWL EMBLEMS

BACKGROUND OF THE INVENTION

The present invention relates to bowls, but more particularly to bowls that contain decorative ornamentation.

Bowls of the above general type are known in the art. People are intrigued by sports related memorabilia. Unfortunately, the sports' emblems and decorations that are on sports' memorabilia, for example, bowls, are not readily changeable. If an avid sports fan purchases an item with a particular sports' emblem, such as team or player names, logos, numbers, and scenes, and at a later date changes his preference he would be anxious to have items reflecting his new preference. This would involve the expense and inconvenience of purchasing all new sports' memorabilia.

SUMMARY OF THE INVENTION

Accordingly, it is a primary object of the present invention to provide a super bowl which avoids the disadvantages of the prior art.

It is another object of the present invention to provide a super bowl having interchangeable emblem bearing attachments.

It is still another object of the present invention to provide a super bowl having either an internal or external track disposed on its outer surface for slidably removeably receiving either an internal, external or reversible mountable attachment.

It is yet another object of the present invention to provide a super bowl in which the attachments are received by an elastic belt that is fitted in a concave circumferential track disposed on the outer surface of the super bowl.

Further objects of the invention will appear as the description proceeds.

To the accomplishment of the above related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
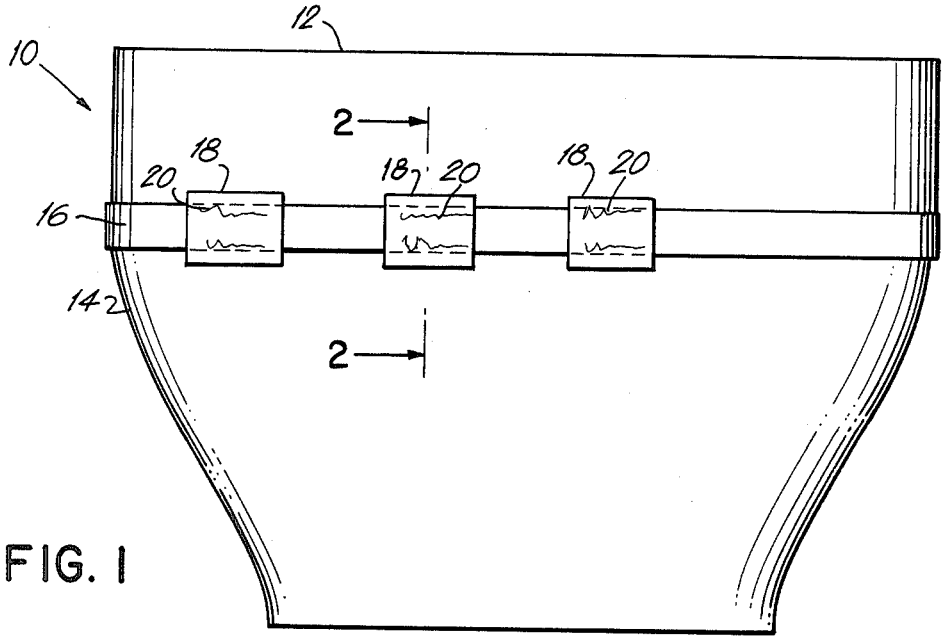
FIG. 1 is a front view of a bowl incorporating one form of the present invention.

Referring now to FIG. 1, the super bowl is shown generally at 10 having an open top 12 and being hollow. The shape of the super bowl is that of a substantially inverted dome and it has a contoured outer surface 14 with a circumferential external track 16. A plurality of attachments generally shown at 18 adaptable for an emblem 20 is slidably removeably mounted to the track 16.

Figure 2:
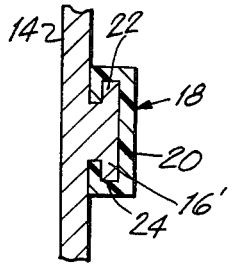
FIG. 2 is a cross sectional view taken along line 2—2 in FIG. 1 and showing an external track received by an attachment with an emblem.

Shown in FIG. 2, the external track 16 has an external slide portion 22. The attachment 18 is in the form of a substantially reversed "C"-shape. The attachment 18 has a hollowed out portion 24 which is received by the external slide portion 22 of the external track 16.

Figure 3:
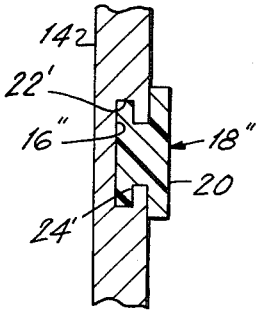
FIG. 3 is a cross sectional view similar to FIG. 3 and showing a second form of the present invention in which the track is internal and is received by an attachment with an emblem.

Shown in FIG. 3, the track is internal and is designated by 16″ and has an internal slide portion 22′. The attachment is in the form of a substantially "H"-shape and is designated by 18″. The attachment 18″ has a projecting portion 24′ which is received by the internal slide portion 22′ of the internal track 16″.

Figure 5:
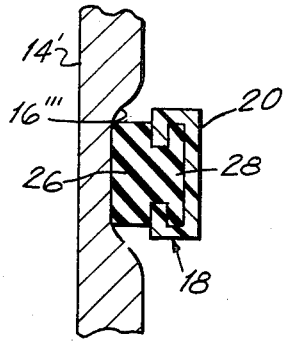
FIG. 5 is a cross sectional view taken along line 5—5 in FIG. 4.
Figure 4:
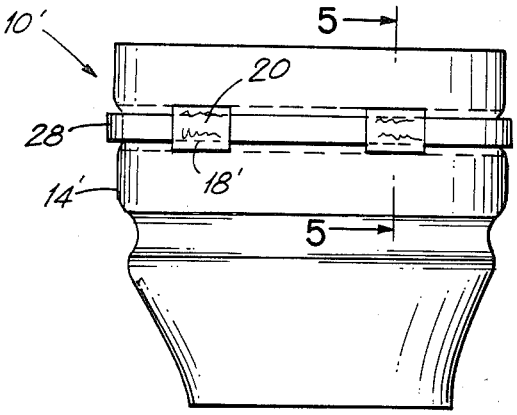
FIG. 4 is a front view of a third form of the present invention which has an integral contoured surface which receives an elastic belt with an integral track.

FIGS. 4 and 5 show an alternate embodiment of the super bowl and is designated as 10′. The bowl 10′ has a substantially concaved shaped circumferential track 16‴, disposed on its outer surface 14′ which receive a one piece elastic belt 26 and external track 28 combination. The external track portion 28 of the elastic belt 26 functions in the same way as the external track 16 of FIG. 2 and receives the attachment 18. It should be mentioned that the track portion of the elastic belt 26 can be formed with an internal track and function in the sale way as the internal track 16″ of FIG. 3 and receives the attachment 18″.

Figure 6:
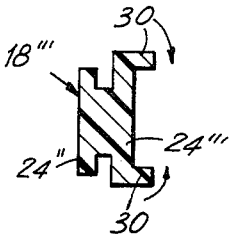
FIG. 6 is a cross sectional view of a fourth form of the present invention in which the attachment is reversible and can be used on either the internal or external track.

FIG. 6 shows a reversible attachment 18‴ which has both a projecting portion 24″ received by the internal track 16″ when the super bowl 10 has a circumferential internal track and a hollowed out portion 24‴, with bendable arms 30, received by the external track 16 when the super bowl 10 has a cicumferential external track.

What is claimed is:

1. A bowl comprising:

(a) a hollow opened top substantially inverted dome shaped body having a contoured vertical outer surface provided with circumferential track, projecting transversely outward of said surface;

(b) at least one attachment adaptable for an emblem and being slideably removeably mounted on said track; and (c) means for attaching said at least one attachment to said body, wherein said emblem is displayed projecting transversely outward of said outer surface, wherein said means comprise an inwardly directed flange on said attachment and an outwardly directed flange on said track, wherein said track is an elastic belt mounted on a groove on said outer surface.

2. An emblem with reversible opposite sides having means on each side adapted to be slidingly mounted respectively on an internal track and an external track comprising a groove with a first flange on one side superimposed on an opposite of said groove, said second flange including flexible spaced arms whereby said first flange is adapted for an internal track and said second flange and arms is adapted for an external track.

* * * * *